US010745919B1

(12) United States Patent
Houston et al.

(10) Patent No.: US 10,745,919 B1
(45) Date of Patent: Aug. 18, 2020

(54) METHOD AND APPARATUS FOR INSTALLING A STAIRCASE ASSEMBLY INTO A BUILDING

(71) Applicant: BIG TIME INVESTMENT, LLC, Southfield, MI (US)

(72) Inventors: Stephen T. Houston, Lake Orion, MI (US); Nicholas Joseph Kalinski, Berkley, MI (US)

(73) Assignee: BIG TIME INVESTMENT, LLC, Southfield, MI (US)

( * ) Notice: Subject to any disclaimer, the term of this patent is extended or adjusted under 35 U.S.C. 154(b) by 0 days.

(21) Appl. No.: 16/523,086

(22) Filed: Jul. 26, 2019

(51) Int. Cl.
*E04F 11/06* (2006.01)
*E04F 11/022* (2006.01)
*E04B 1/35* (2006.01)

(52) U.S. Cl.
CPC ..... *E04F 11/066* (2013.01); *E04B 1/3516* (2013.01); *E04F 11/022* (2013.01)

(58) Field of Classification Search
CPC ..... E04F 11/066; E04F 11/022; E04F 11/06; E04F 11/062; E04F 11/04; E04B 1/3516
See application file for complete search history.

(56) References Cited

U.S. PATENT DOCUMENTS 3,283,465 A 11/1966 Cheskin
3,686,816 A * 8/1972 Erbil ..... E04B 1/3404 52/83
3,707,814 A * 1/1973 Seegers ..... E04F 11/02 52/185
4,071,988 A 2/1978 Bowes
4,707,957 A * 11/1987 Shepherd ..... E04F 11/06 182/115
7,448,470 B2 * 11/2008 Brown ..... B66F 11/042 182/63.1
7,784,231 B2 * 8/2010 Termohlen ..... E04B 1/3516 52/236.5
7,971,408 B2 * 7/2011 Hayes, Sr. ..... E04G 27/00 52/143
2007/0051559 A1 * 3/2007 Brown ..... B66F 11/042 182/63.1
2008/0236065 A1 * 10/2008 Conservano ..... E04F 11/022 52/185
2008/0276550 A1 * 11/2008 Termohlen ..... E04B 1/3516 52/169.9
2010/0293875 A1 * 11/2010 Preston ..... E04F 11/022 52/183
2019/0093367 A1 * 3/2019 Vanker ..... E04F 11/02

FOREIGN PATENT DOCUMENTS

WO WO-2017024349 A1 * 2/2017 ..... E04F 11/062
WO WO-2018212956 A1 * 11/2018 ..... E04F 11/022

* cited by examiner

*Primary Examiner* — Rodney Mintz
(74) *Attorney, Agent, or Firm* — Quinn IP Law

(57) ABSTRACT

A staircase assembly is installed in a multi-story building, including first and second flights of stairs that are hingably coupled to a landing, and a plurality of vertically-oriented columns coupled to the landing. The staircase assembly is assembled into a first liftable floor plate, and is disposed in a folded arrangement when the liftable floor plate is positioned at an assembly level elevation. The staircase assembly is disposed in an unfolded arrangement when the first liftable floor plate is positioned at a first design level elevation and a second liftable floor plate that is positioned at a second design level elevation below the first liftable floor plate.

19 Claims, 5 Drawing Sheets

METHOD AND APPARATUS FOR INSTALLING A STAIRCASE ASSEMBLY INTO A BUILDING

TECHNICAL FIELD

The disclosure generally relates to a method of constructing a building, and a vertical slip form construction system therefor, and assembling and installing a staircase assembly as part of the building construction.

BACKGROUND

Many methods of constructing multi-story buildings exist. Traditionally, multi-story buildings have been constructed from the ground up, in which construction of the building begins on a ground level by attaching higher elevation structural elements on top of previously assembled lower structural elements to construct the building in an upward direction, i.e., from bottom up. This construction method requires that the structural elements, e.g., staircase assemblies, be lifted by a crane and connected in situ at elevation.

Known methods for constructing high-rise buildings may be inefficient. Presently, structural framing elements may be assembled into a building frame one member at a time, well above ground level. Tower cranes may be used to facilitate construction, which may include executing thousands of individual lifts for each element of the structure, building enclosure, finishes, staircase assemblies, mechanical and electrical equipment and many other components of a finished building. These operations may require specialized equipment and setup logistics, and may be time-consuming and costly when constructing tall buildings.

SUMMARY

A multi-story building that includes a vertical support core and a plurality of liftable floor plates is described, wherein fabrication of the building includes fabricating each of the floor plates at or near ground level, and lifting each of the floor plates to a final position on the vertical support core.

A staircase assembly is installed in the multi-story building. The staircase assembly includes first and second flights of stairs that are hingably coupled to a landing, and a plurality of vertically-oriented columns coupled to the landing. The staircase assembly is assembled into a first liftable floor plate, and is disposed in a folded arrangement when the liftable floor plate is positioned at an assembly level elevation. The staircase assembly is disposed in an unfolded arrangement when the first liftable floor plate is positioned at a first design level elevation and a second liftable floor plate that is positioned at a second design level elevation below the first liftable floor plate.

An aspect of the disclosure includes the staircase assembly further including a first end of the first flight of stairs being hingably attached to the landing, and a first end of the second flight of stairs being hingably attached to the landing.

Another aspect of the disclosure includes a second end of the first flight of stairs being attached to the first liftable floor plate when the first liftable floor plate is positioned at the first design level elevation, and a second end of the second flight of stairs attached to the second liftable floor plate that is disposed below the first liftable floor plate when the second liftable floor plate is positioned at the second design level elevation.

Another aspect of the disclosure includes each of the columns including an upper portion and a lower portion, wherein the upper portion of each of the columns is secured to the first liftable floor plate when the first liftable floor plate is positioned at the design level elevation and the staircase assembly is disposed in the unfolded arrangement, and wherein the lower portion of each of the columns is secured to the second liftable floor plate that is disposed below the first liftable floor plate when the first liftable floor plate is positioned at the design level elevation and the staircase assembly is disposed in the unfolded arrangement.

Another aspect of the disclosure includes a liftable floor plate for a multi-story building, including a floor plate frame slidably disposed on a vertical support core and a staircase assembly including first and second flights of stairs, a landing, and a plurality of vertically-oriented columns. The staircase assembly is attached to the floor plate frame, the first and second flights of stairs are hingably coupled to the landing, and the plurality of vertically-oriented columns are coupled to the landing. The staircase assembly is disposed in a folded arrangement when the liftable floor plate is positioned at an assembly level elevation, and is disposed in an unfolded arrangement when the liftable floor plate is positioned at a design level elevation.

Another aspect of the disclosure includes a method for fabricating a staircase assembly for a multi-story building, which includes fabricating a first liftable floor plate at an assembly level elevation, fabricating a staircase assembly including hingably attaching first and second flights of stairs to a landing, arranging the staircase assembly in a folded state, and attaching the staircase assembly to the first liftable floor plate at the assembly level elevation, wherein the staircase assembly is arranged in the folded state. The first liftable floor plate is lifted to a design level elevation, and the staircase assembly is unfolded, which includes attaching a portion of the first flight of stairs to the first liftable floor plate and attaching a portion of the second flight of stairs to a second liftable floor plate, wherein the second liftable floor plate is disposed below the first liftable floor plate.

The above features and advantages and other features and advantages of the present teachings are readily apparent from the following detailed description of the best modes for carrying out the teachings when taken in connection with the accompanying drawings.

The appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the drawings are in simplified form and are not to precise scale. For purposes of convenience and clarity only, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein. Terms such as "above," "below," "upward," "downward," "top," "bottom," etc., are used descriptively for the figures, and do not represent limitations on the scope of the disclosure, which is defined by the appended claims. The term "horizontal" and related terms describe an orientation that is parallel with ground elevation. The term "vertical" and related terms describe an orientation that is orthogonal to ground elevation.

Figure 1:
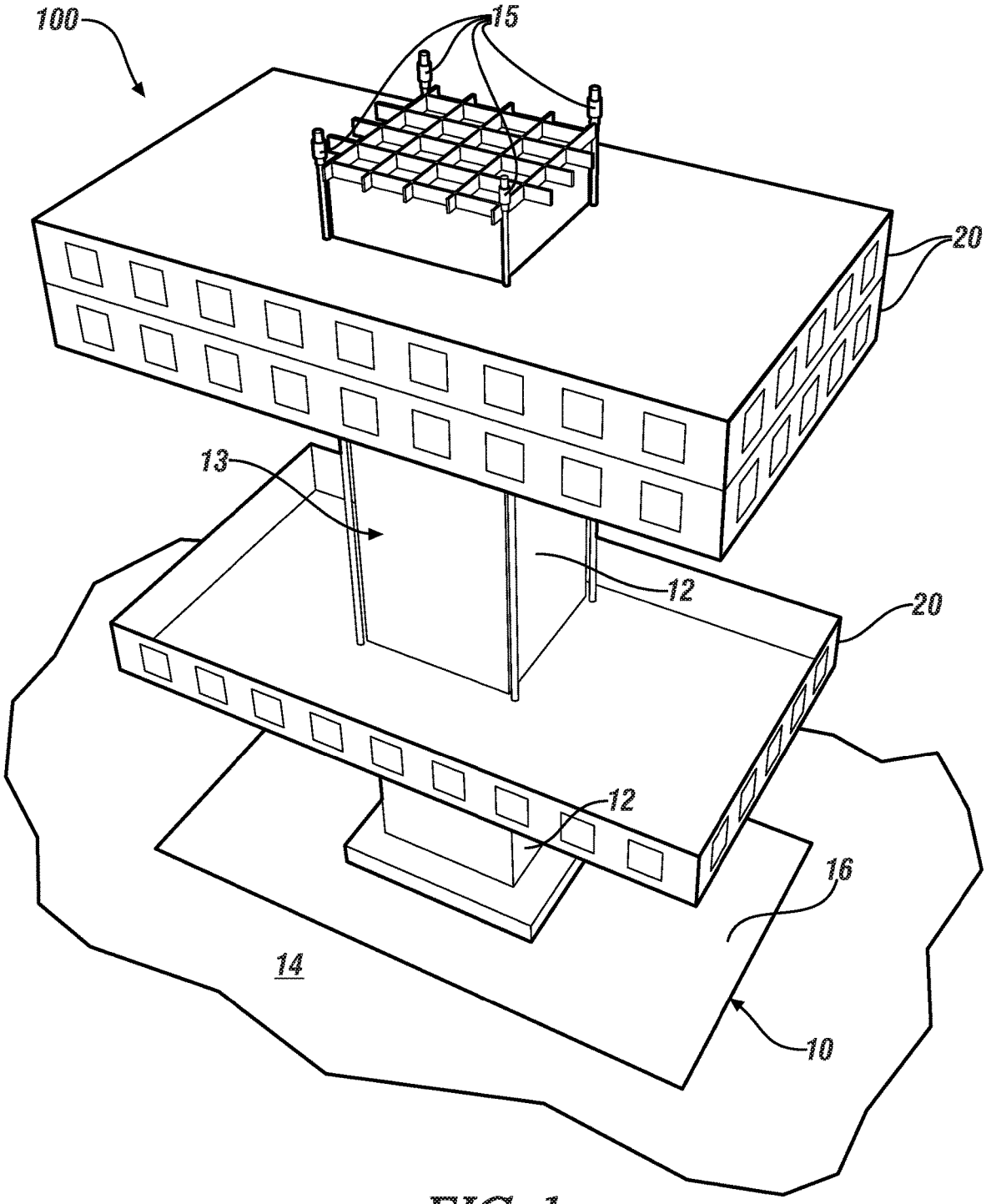
FIG. 1 is a schematic perspective view of a partially constructed building, in accordance with the disclosure.

Referring to the Figures, wherein like numerals indicate like parts throughout the several views, a partially-constructed multi-story building 100 is shown in FIG. 1. The partially-constructed multi-story building 100 is being constructed employing a novel construction system. The construction system may be used to implement a top-down construction process, in which a plurality of floor plates 20 are sequentially constructed at an assembly level elevation, e.g., at or near ground elevation 14, and are lifted to a respective design level elevation and attached to a vertical support core 12 of the building 100 in a descending, sequential order. The building 100 includes the vertical support core 12, which is assembled onto a foundation 10, and a plurality of the floor plates 20. As shown, the building 100 includes a plurality of floor plates 20, including a topmost floor plate 20 covered by a roof, and a first intermediate floor plate 20 that are disposed at respective design-level elevations. Another of the floor plates 20 is disposed at an assembly level elevation, e.g., at or near ground elevation 14.

As used herein, the term "floor plate 20" includes all structural or frame members, e.g., joists and/or purlins, flooring, e.g., concrete floor, interior walls, exterior curtain walls, modular room subassemblies, e.g., a lavatory module, utilities, etc., that form a floor or level of the building 100. The term "floor plate 20" may include a plate for the roof structure of the building 100, as well as a plate for a floor or level of the building 100. Accordingly, the term "floor plate 20" is used herein to refer to both the roof structure for the roof of the building 100, as well as a floor structure for a floor or level of the building 100. As used herein and shown in the Figures, the reference numeral 20 may refer to and indicate any floor plate 20 of the building 100. The floor plate 20 specifically includes a floor plate frame 21, the fabrication of which is described herein. Each of the floor plates 20 is described as being liftable, in that they are assembled at an assembly level elevation, e.g., at or near ground elevation 14, and lifted into their respective design elevations, which is their final assembled elevation in the building 100.

The construction system includes the vertical support core 12, which is an element of a vertical slip form system 13. The vertical slip form system 13 is operable to form the vertical support core 12 of the building 100 from a hardenable material while moving vertically upward from the assembly level elevation, e.g., at or near ground elevation 14 to a design level elevation. The hardenable material may include, but is not limited to, a concrete mixture or other similar composition. The hardenable material may include one or more additives to enhance one or more physical characteristics of the hardenable material, such as to reduce curing time, reduce slump, increase strength, etc. The specific type and contents of the hardenable material may be dependent upon the specific application of the building 100, and may be dependent upon the specific geographic region in which the building 100 is being constructed. The specific type and contents of the hardenable material are understood by those skilled in the art, are not pertinent to the teachings of this disclosure, and are therefore not described in greater detail herein.

The vertical support core 12 is designed to carry the vertical loads of the building 100. As such, the shape of the vertical support core 12 may be designed as necessary to provide the required compressive strength, shear strength, and bending strength for the particular application, size, and location of the building 100. The wall of the vertical support core 12 may be configured to include multiple load bearing columns connected by shear walls. In other embodiments, the wall of the vertical support core 12 may be designed to include a generally uniform construction around the entire perimeter of the vertical support core 12.

The construction system may further include one or a plurality of lifting device(s) 15 attached to the vertical support core 12, which may be used for raising the floor plates 20 relative to the vertical support core 12. For example, the lifting devices 15 may include, but are not limited to a plurality of strand jacks. However, the lifting devices 15 may include other devices capable of lifting each of the floor plates 20 of the building 100. The strand jacks grasp and move a cable to lift heavy objects. The specific features and operation of the lifting devices 15 are known to those skilled in the art, are not pertinent to the teachings of this disclosure, and are therefore not described herein. The roof structure and each of the floor plates 20 may be assembled at an assembly level elevation, e.g., at or near ground elevation 14, and lifted into their respective design elevations relative to the vertical support core 12 in a sequential descending order.

The floor plates 20 compose discrete sections of the building 100. Each of the floor plates 20 may be assembled at an assembly level elevation, e.g., at or near ground elevation 14. Each of the floor plates 20 may be lifted to a corresponding design level elevation employing one or more of the lifting devices 15 or other vertical conveyance structure(s), and permanently affixed to and supported by the vertical support core 12. The floor plates 20 are cantilevered from the lifting devices 15 and therefore, the weight of each of the floor plates 20 is best distributed symmetrically around the vertical support core 12 and the lifting devices 15. The floor plates 20 may be designed asymmetrically around the lifting devices 15 so long as proper design and loading techniques are utilized.

Figure 2:
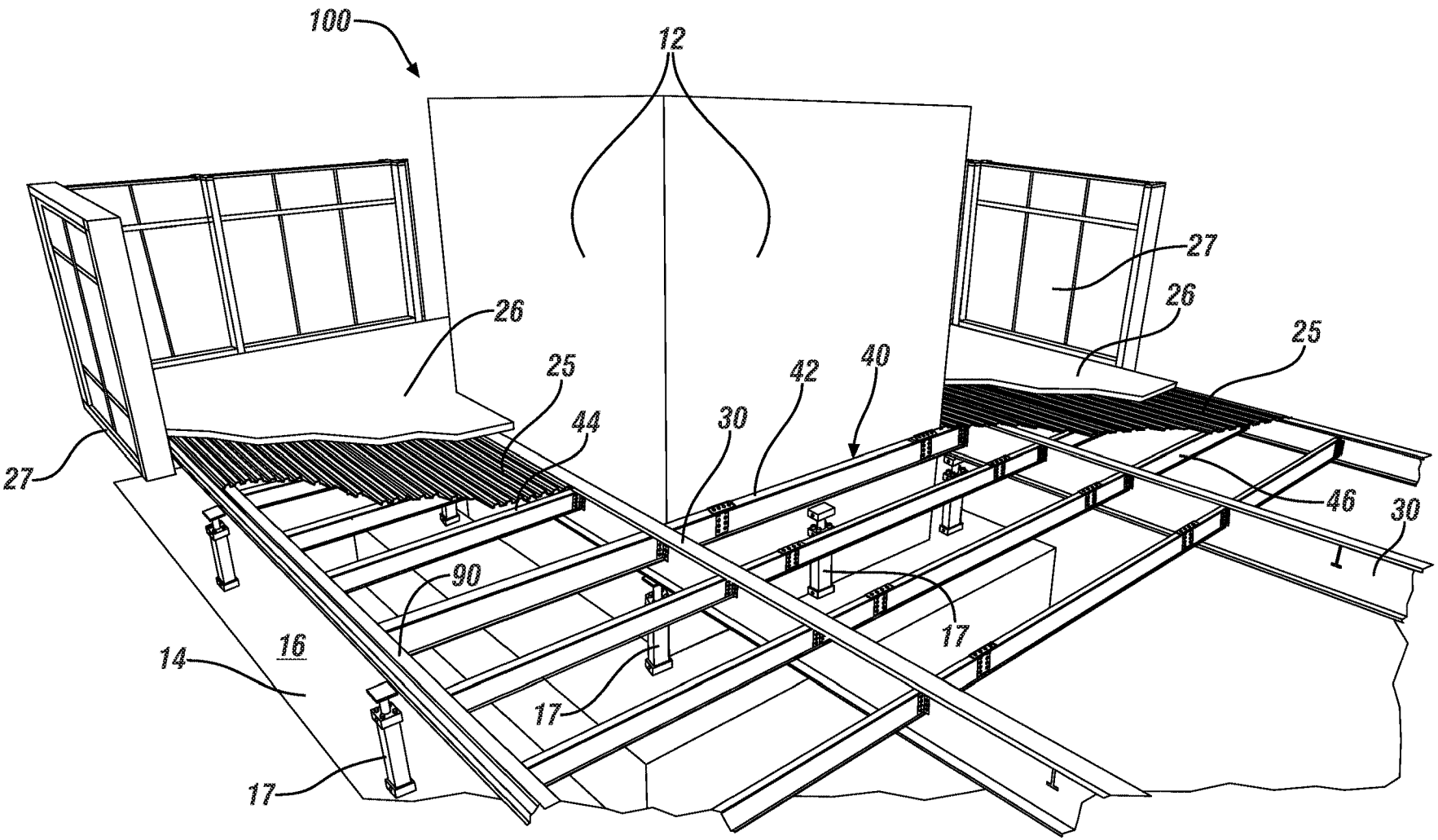
FIG. 2 is a schematic perspective view of elements of a partially constructed building, including a floor plate including metal decking, and a vertical support core, in accordance with the disclosure.

FIG. 2 schematically shows a perspective view of an embodiment of a portion of the building 100, including portions of the partially assembled floor plate 20 that is disposed at an assembly level elevation, e.g., ground elevation 14, and a portion of the vertical support core 12. Each of the floor plates 20 is assembled as a woven structure in the form of main framing members, e.g., girders 30, a plurality of transversely-oriented continuous framing members 40, and spandrels 90. The girders 30 run continuously between supports that may be attached to the lifting devices 15. As shown and described with reference to FIGS. 3 and 4, a staircase assembly 70 in a folded state is assembled into each of the floor plates 20.

Referring again to FIG. 2, the girders 30, respectively, are arranged in parallel and are slidably disposed on opposed sides of the vertical support core 12 in a manner that permits and facilitates vertical conveyance to the design level elevation. The girders 30 may each be configured, by way of non-limiting examples as an I-beam, a C-beam, a T-beam, an L-beam, a square beam, a rectangular beam, etc. A plurality of apertures are formed in vertically-oriented web portions of the girders 30, and are configured to accommodate insertion of one of the first and second cantilevered beams 44, 46. The girders 30 are disposed on a plurality of pedestals 17 that are disposed on an assembly pad 16, which is fabricated over the foundation 10.

Each of the continuous framing members 40 is an assembled part that includes a medial beam 42 and first and second cantilevered beams 44, 46. The medial beam 42 and the first and second cantilevered beams 44, 46 are each configured to have a flat beam section on a top portion of the respective beam along its longitudinal axis. The medial beam 42 may be configured as an I-beam, a C-beam, a T-beam, an L-beam, a square beam, a rectangular beam, etc., which defines a respective cross-sectional shape. Each of the first and second cantilevered beams 44, 46 may be an I-beam, a C-beam, a T-beam, an L-beam, a square beam, a rectangular beam, etc., which defines a respective cross-sectional shape. The cross-sectional shape associated with the first cantilevered beam 44 corresponds to the respective aperture in the first of the girders 30, and the cross-sectional shape associated with the second cantilevered beam 46 corresponds to the respective aperture in the second of the girders 30. The medial beams 42 are horizontally disposed between the girders 30. The continuous framing members 40 penetrate the girders 30 and are supported at multiple points with preset cambers. Camber is defined as a deviation from a flat, level, horizontal plane.

The first end of each of the first cantilevered beams 44 is threaded through one of the apertures of the first of the girders 30 and is attached to the respective medial beam 42. The first cantilevered beam 44 is also attached to the first of the girders 30 mid-span employing angle plates and friction bolts via other bolt through-holes. The second ends of the first cantilevered beams 44 are attached to one of the spandrels 90 in one embodiment. The first end of each of the second cantilevered beams 46 is threaded through one of the apertures of the second of the girders 30 and is attached to the respective medial beam 42. The second cantilevered beam 46 is also attached to the first of the girders 30 mid-span employing angle plates and friction bolts via other bolt through-holes. The second ends of the second cantilevered beams 46 are attached to another spandrel 90.

This arrangement results in a floor assembly that is strong, and thus can be exploited to reduce beam depth without increasing vertical deflection. The woven structure-framed roof and floor plates impart precise amounts of camber at junctions. The junctions may be formed employing friction bolts and plates at inflection points to meet camber requirements. The combination of bolted, four-sided junctions together with the woven structure creates an efficient and flexible roof and floor plate structure that may be adjusted for camber control during assembly. The woven structure maximizes the strength of the transverse members, e.g., framing members 40, permitting beam depth to be minimized. Weight and overall depth of the floor plates 20 is thereby minimized. Furthermore, openings in the girders 30 that permit the transverse beams to penetrate are cut to close tolerances, providing bracing at locations of penetrations. This bracing may prevent unintended rotation of the transverse members during assembly before junctions have been installed. The camber of each of the floor plates 20 in its final assembled state is determined by engineering calculation, resulting in a final deflection value from true level at key points along the structural frame. The camber required for the floor plate 20 can then be set so that it will achieve a flat, level configuration in its final connected condition.

As shown, the floor plate 20 is partially assembled, including metal decking 25 that is attached onto an underside portion of the floor plate frame 21. The metal decking 25 provides a lower plate on which hardenable material can be poured to form a completed floor 26 during fabrication. Exterior curtain walls 27 are disposed around the outer periphery of the floor plate frame 21 and attached to the spandrels 90.

The pedestals 17 may include two-way hydraulic cylinders that are connected to the assembly pad 16 and connected to the portion of the floor plate 20 being supported. The pedestals 17 may be computer-controlled hydraulic cylinders that provide the capability to make in-field height adjustments to adjust camber, which in turn facilitates the achievement a high degree of floor flatness. The pedestals 17 move, i.e., vertically adjust the floor plate frame 21 to the desired right camber position before the hardenable material has cured, and hold the floor plate frame 21 in position during curing in order to achieve a desired flatness. This operation facilitates shaping the floor plate 20 while it is being fabricated and while the hardenable material is being poured by making in-process adjustments. Flatness can be monitored and adjusted while the hardenable material is being poured and during curing. As each of the floor plates 20 is lifted and locked in to its permanently supported condition at its design elevation, the achieved flatness is measured and outcomes may be used to adjust the geometry of the next one of the floor plates 20 being fabricated. This process improves the flatness tolerance of each successive floor plate.

Figure 3:
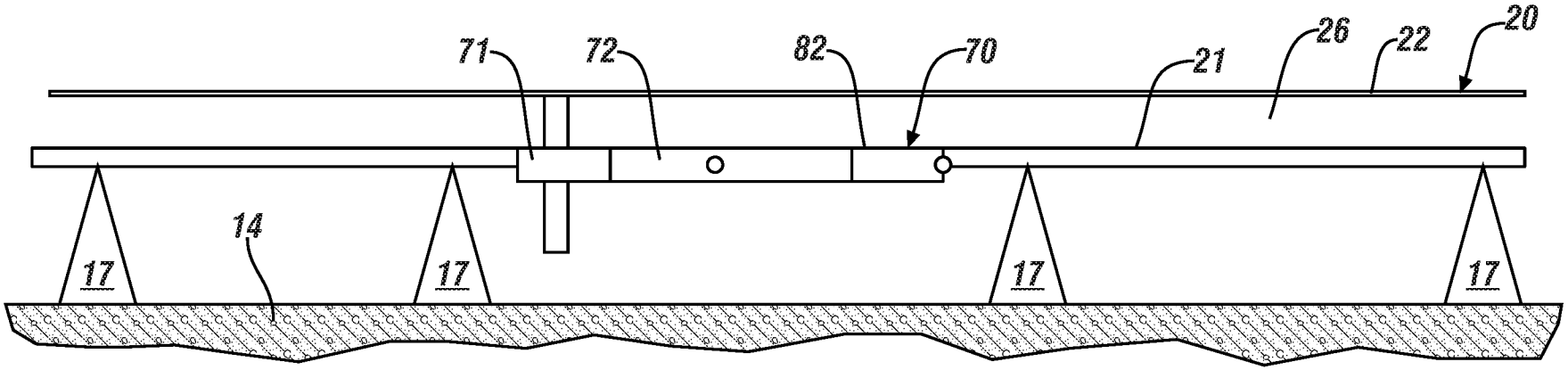
FIG. 3 schematically shows a side-view perspective of a partially assembled floor plate frame that is disposed at ground elevation and includes an embodiment of a staircase assembly in a folded state, in accordance with the disclosure.
Figure 4:
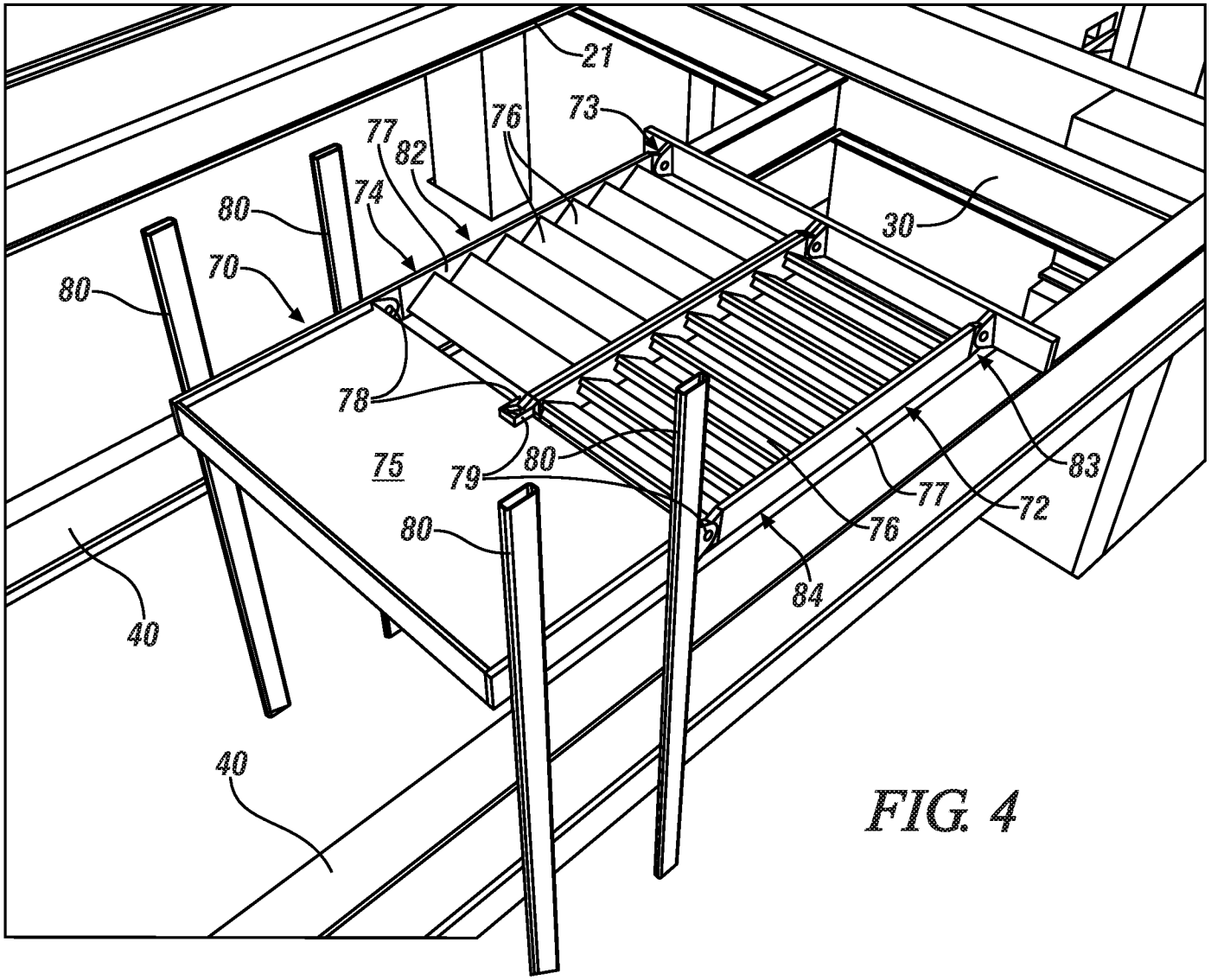
FIG. 4 schematically shows an isometric top-view perspective of a partially assembled floor plate frame that is disposed at ground elevation and includes an embodiment of a staircase assembly in a folded state, in accordance with the disclosure.

FIGS. 3 and 4 schematically show a side-view and isometric top-view, respectively, of the staircase assembly 70 arranged in the folded state and assembled into a partially assembled floor plate frame 21 that is disposed at an assembly level elevation, e.g., ground elevation 14. The partially assembled floor plate frame 21 includes the metal decking 25 with flooring 26 overtop. The staircase assembly 70 includes a landing 71, a first flight of stairs 72, and a second flight of stairs 82. As used herein, the term "flight of stairs" is defined as a continuous, uninterrupted series of steps 76 arranged in-line. The first and second flights of stairs 72, 82 are both composed as a plurality of steps 76 that span between a pair of stringers 77 in one embodiment. When the first and second flights of stairs 72, 82 are in unfolded states, each of the steps 76 is horizontally-oriented. The first and second flights of stairs 72, 82 are positioned in a side-by-side arrangement when the staircase assembly 70 is in the folded state. A first end 73 of the first flight of stairs 72 is connected to the respective floor plate frame 21. A second end 74 of the first flight of stairs 72 is connected to the landing 71 via first hinges 78. A first end 83 of the second flight of stairs 82 is secured to a frame (not shown) of the staircase assembly 70 or the respective floor plate frame 21. A second end 84 of the second flight of stairs 82 is connected to the landing 71 via second hinges 79. The landing 71 as shown has a surface portion 75 that is rectangularly-shaped in the horizontal orientation. Alternatively, the surface portion 75 of the landing 71 may have another shape, e.g., hemispherical, trapezoidal, etc., in the horizontal orientation.

A plurality of support columns 80 are disposed in a vertical direction at or near corners of the landing 71. As shown, and when disposed in the folded state at the ground elevation 14, a first portion of each of the support columns 80 projects upward above the landing 71, and a second portion of each of the support columns 80 projects downward below the landing 71.

The staircase assembly 70 may be prefabricated and manufactured with integral hinged or scissor connections to facilitate shipment in a compact form in the folded state. This serves to simplify and minimize on-site assembly, reducing installation labor and eliminating the need to hoist and place each subassembly. Ramps may also be prefabricated in this manner.

Figure 5:
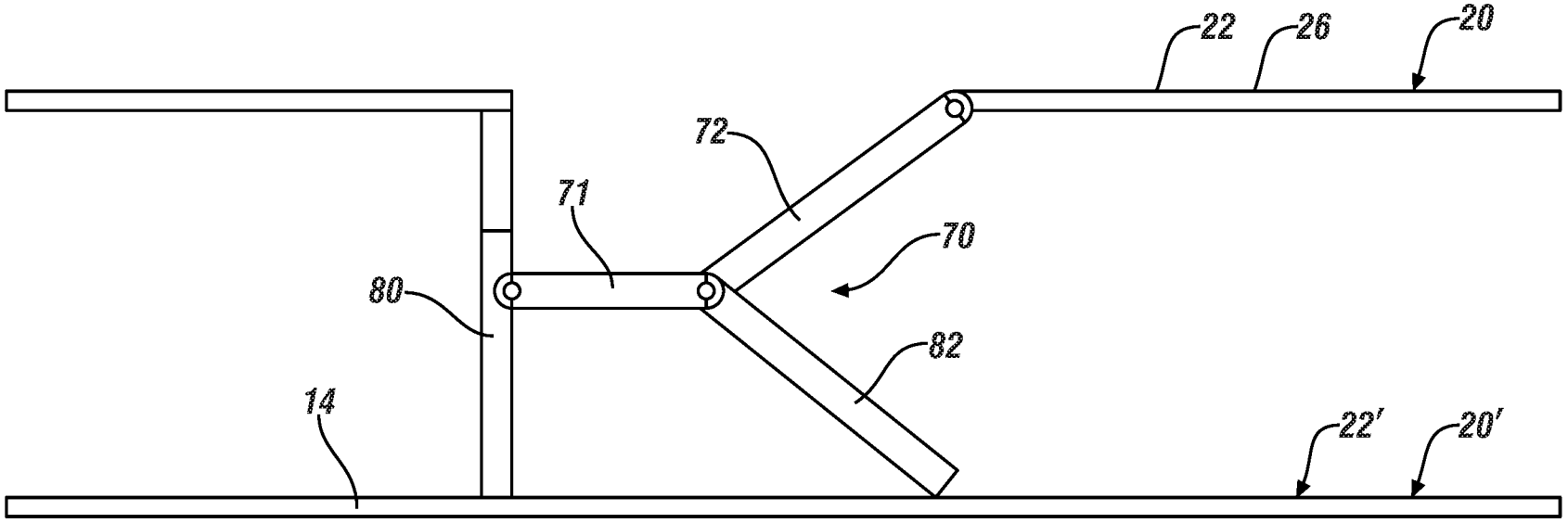
FIG. 5 schematically shows a side-view perspective of a floor plate that is disposed at a design level elevation and includes an embodiment of a staircase assembly in an unfolded state, in accordance with the disclosure.
Figure 6:
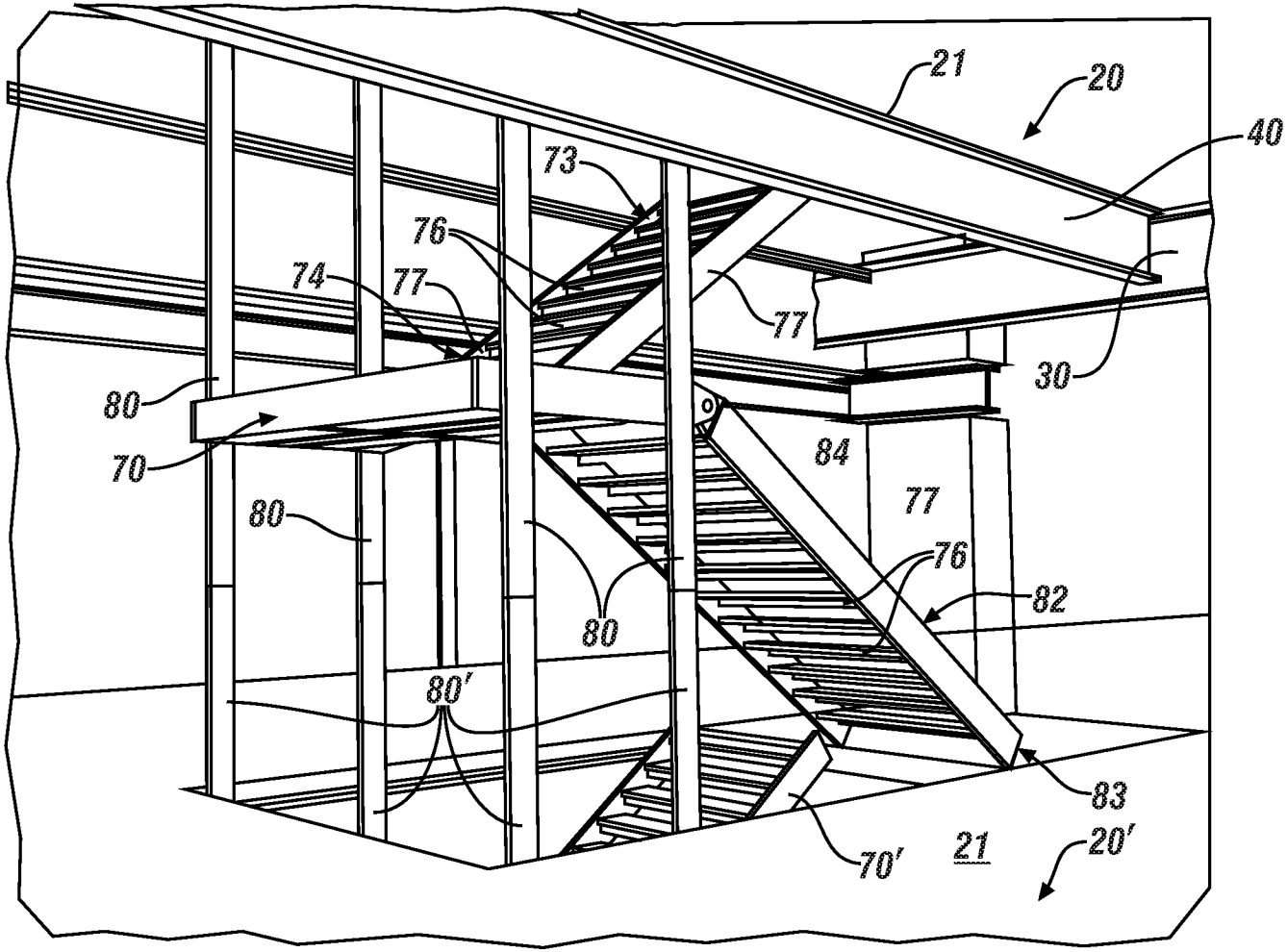
FIG. 6 schematically shows an isometric top-view perspective of a partially assembled floor plate that is disposed at a design level elevation and includes an embodiment of a staircase assembly in an unfolded state, in accordance with the disclosure.

FIGS. 5 and 6 schematically show a side view and isometric side-view, respectively, of the staircase assembly 70 in the unfolded state and arranged between the floor plate 20, which is disposed at its respective design level elevation 22, and a second floor plate 20', which is disposed at its respective design level elevation 22'. The staircase assembly 70 includes the landing 71, the first flight of stairs 72, and the second flight of stairs 82, which are composed of a plurality of steps 76 that span between a pair of stringers 77 in one embodiment. As shown, when the first and second flights of stairs 72, 82 are in unfolded states, each of the steps 76 is horizontally-oriented. The first end 73 of the first flight of stairs 72 is connected to the floor plate 20. A second end 74 of the first flight of stairs 72 is connected to the landing 71 via first hinges 78. The first end 83 of the second flight of stairs 82 is secured to the second floor plate 20'. The second end 84 of the second flight of stairs 82 is connected to the landing 71 via second hinges 79.

The support columns 80 are disposed in a vertical direction at or near corners of the landing 71. As shown, when disposed in the unfolded state at the ground elevation 14, the first portion of each of the support columns 80 projects upward above the landing 71 and attaches to the floor plate 20. The second portion of each of the support columns 80 projects downward below the landing 71. As shown, the second portion of each of the support columns 80 connects to a first portion of support columns 80' for a second staircase assembly 70' that is assembled into the second floor plate 20', and the support columns 80' attach to the second floor plate 20'.

Referring again to FIGS. 3, 4, 5 and 6, the staircase assembly 70 can be assembled and attached to one of the floor plates 20 of an embodiment of the multi-story building 100 that is described with reference to FIGS. 1 and 2. The staircase assembly 70 includes the first and second flights of stairs 72, 82 hingably coupled to the landing 71, with a plurality of vertically-oriented columns 80 coupled to the landing 71 to provide support. The staircase assembly 70 is disposed in a folded arrangement, shown with reference to FIGS. 3 and 4, when the liftable floor plate 20 is positioned at the assembly level elevation, e.g., at or near ground elevation 14. The staircase assembly 70 is disposed and arranged in the unfolded arrangement when the liftable floor plate 20 is positioned at its respective design level elevation 22 with a second liftable floor plate 20' being is positioned at a second design level elevation 22' that is positioned below the floor plate 20.

Installing the staircase assembly 70 into an embodiment of the multi-story building 100 that is described with reference to FIGS. 1 and 2 includes fabricating the staircase assembly 70, which includes hingably attaching the first and second flights of stairs 72, 82 to the landing 71, and arranging the staircase assembly 70 in a folded state. As a part of fabricating the liftable floor plate 20 at the assembly level elevation e.g., at or near ground elevation 14, the staircase assembly 70 is installed into the first liftable floor plate 20. At this point, the vertically-oriented columns 80 are coupled to the landing 71, such that an upper portion extends upward above the landing 71 and a lower portion extends below the landing 71. When assembly of the floor plate 20 is completed, it is lifted to its design level elevation 22 via the lifting device(s) 15 and fixedly secured onto the vertical support core 12 in its final position.

The staircase assembly 70 can then be unfolded, which includes lowering the first flight of stairs 72 and the landing 71 to a desired vertical position for the landing 71 and securing the upper portions of the vertically-oriented columns 80 the floor plate 20. The second flight of stairs 82 is then lowered to and connected to a second floor plate 20' that is position below the floor plate 20, after the second floor plate 20' has been lifted to its design level elevation 22'. The lower portions of the vertically-oriented columns 80 are secured to the second liftable floor plate 80'.

In this manner, a staircase assembly for an embodiment of the building 100 that is fabricated employing the construction system described herein may be efficiently fabricated, transported, assembled into an embodiment of the floor plate 20, and unfolded and secured in place.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A staircase assembly disposed in a multi-story building that includes a first liftable floor plate and a second liftable floor plate, the staircase assembly comprising:

first and second flights of stairs hingably coupled to a landing; and a plurality of vertically-oriented columns coupled to the landing;

wherein the staircase assembly is attached to a floor plate frame of the first liftable floor plate;

wherein the staircase assembly is configured to be disposed in a folded arrangement and an unfolded arrangement;

wherein, in the folded arrangement, the staircase assembly and the first liftable floor plate are positioned at an assembly level elevation; and wherein, in the unfolded arrangement, the staircase assembly is disposed between the first liftable floor plate and the second liftable floor plate, the first liftable floor plate is positioned at a first design level elevation, and the second liftable floor plate is positioned at a second design level elevation below the first liftable floor plate.

2. The staircase assembly of claim 1, further comprising:

a first end of the first flight of stairs being hingably attached to the landing; and a first end of the second flight of stairs being hingably attached to the landing.

3. The staircase assembly of claim 2, further comprising:

a second end of the first flight of stairs attached to the first liftable floor plate when the first liftable floor plate is positioned at the first design level elevation; and a second end of the second flight of stairs attached to the second liftable floor plate that is disposed below the first liftable floor plate when the second liftable floor plate is positioned at the second design level elevation.

4. The staircase assembly of claim 3, wherein each of the columns includes an upper portion and a lower portion;

wherein the upper portion of each of the columns is secured to the first liftable floor plate when the first liftable floor plate is positioned at the first design level elevation and the staircase assembly is disposed in the unfolded arrangement; and wherein the lower portion of each of the columns is secured to the second liftable floor plate that is disposed below the first liftable floor plate when the first liftable floor plate is positioned at the first design level elevation and the staircase assembly is disposed in the unfolded arrangement.

5. A liftable floor plate for a multi-story building, comprising:

a floor plate frame slidably disposed on an external portion of a vertical support core; and a staircase assembly including first and second flights of stairs, a landing, and a plurality of vertically-oriented columns;

wherein the staircase assembly is attached to the floor plate frame;

wherein the first and second flights of stairs are hingably coupled to the landing;

wherein the plurality of vertically-oriented columns are coupled to the landing;

wherein the staircase assembly is disposed in a folded arrangement when the liftable floor plate is positioned at an assembly level elevation; and wherein the staircase assembly is disposed in an unfolded arrangement when the liftable floor plate is positioned at a design level elevation.

6. The liftable floor plate of claim 5, wherein the floor plate frame comprises:

first and second girders arranged in parallel and slidably disposed on opposed sides of a vertical support core of the multi-story building; and a plurality of framing members, wherein each framing member is arranged transverse to the first and second girders and supported by the first and the second girders;

wherein the staircase assembly is disposed between adjacent ones of the plurality of framing members.

7. The liftable floor plate of claim 5:

wherein a first end of the first flight of stairs is hingably attached to the landing; and wherein a first end of the second flight of stairs is hingably attached to the landing.

8. The liftable floor plate of claim 7, wherein a second end of the first flight of stairs is attached to the floor plate frame of the liftable floor plate when the liftable floor plate is positioned at the design level elevation; and wherein a second end of the second flight of stairs is attached to a second floor plate frame of a second floor plate that is disposed below the liftable floor plate when the liftable floor plate is positioned at the design level elevation in the unfolded arrangement.

9. The liftable floor plate of claim 8, wherein each of the vertically-oriented columns includes an upper portion and a lower portion;

wherein the upper portion of each of the vertically-oriented columns is secured to the liftable floor plate when the liftable floor plate is positioned at the design level elevation and the staircase assembly is disposed in the unfolded arrangement; and wherein the lower portion of each of the vertically-oriented columns is secured to the second floor plate that is disposed below the liftable floor plate when the liftable floor plate is positioned at the design level elevation and the staircase assembly is disposed in the unfolded arrangement.

10. A method for assembling a staircase assembly into a multi-story building, comprising:

fabricating a first liftable floor plate at an assembly level elevation;

fabricating a staircase assembly including hingably attaching first and second flights of stairs to a landing;

arranging the staircase assembly in a folded state;

attaching the staircase assembly to the first liftable floor plate at the assembly level elevation, wherein the staircase assembly is arranged in the folded state;

lifting the first liftable floor plate to a first design level elevation; and unfolding the staircase assembly, including attaching a portion of the first flight of stairs to the first liftable floor plate and attaching a portion of the second flight of stairs to a second liftable floor plate, wherein the second liftable floor plate is disposed below the first liftable floor plate.

11. The method of claim 10, further comprising attaching a plurality of vertically-oriented columns to the landing of the staircase assembly, wherein each of the columns includes an upper portion and a lower portion;

securing the upper portion of each of the columns to the first liftable floor plate when the first liftable floor plate is positioned at the first design level elevation and the staircase assembly is disposed in an unfolded arrangement; and securing the lower portion of each of the columns to the second liftable floor plate when the first liftable floor plate is positioned at the first design level elevation and the staircase assembly is disposed in the unfolded arrangement.

12. The method of claim 10, wherein hingably attaching first and second flights of stairs to the landing comprises hingably attaching a first end of the first flight of stairs to the landing and hingably attaching a first end of the second flight of stairs to the landing.

13. The method of claim 12, wherein attaching the portion of the first flight of stairs to the first liftable floor plate comprises attaching a second end of the first flight of stairs to the first liftable floor plate when the first liftable floor plate is positioned at the first design level elevation.

14. The method of claim 12, wherein attaching the portion of the second flight of stairs to the second liftable floor plate comprises attaching a second end of the second flight of stairs to the second liftable floor plate, wherein the second liftable floor plate is disposed below the first liftable floor plate when the second liftable floor plate is positioned at a second design level elevation.

15. A method for assembling a staircase assembly into a multi-story building, comprising:

fabricating a first liftable floor plate;

fabricating the staircase assembly including hingably attaching first and second flights of stairs to a landing;

arranging the staircase assembly in a folded state;

attaching the staircase assembly to the first liftable floor plate, wherein the staircase assembly is arranged in the folded state; and unfolding the staircase assembly, including attaching a portion of the first flight of stairs to the first liftable floor plate and attaching a portion of the second flight of stairs to a second liftable floor plate, wherein the second liftable floor plate is disposed below the first liftable floor plate.

16. The method of claim 15, further comprising attaching a plurality of vertically-oriented columns to the landing of the staircase assembly, wherein each of the columns includes an upper portion and a lower portion;

securing the upper portion of each of the columns to the first liftable floor plate when the first liftable floor plate is positioned at a design level elevation; and securing the lower portion of each of the columns to the second liftable floor plate when the staircase assembly is unfolded.

17. The method of claim 15, wherein hingably attaching first and second flights of stairs to the landing comprises hingably attaching a first end of the first flight of stairs to the landing and hingably attaching a first end of the second flight of stairs to the landing.

18. The method of claim 17, wherein attaching the portion of the first flight of stairs to the first liftable floor plate comprises attaching a second end of the first flight of stairs to the first liftable floor plate.

19. The method of claim 17, wherein attaching the portion of the second flight of stairs to the second liftable floor plate comprises attaching a second end of the second flight of stairs to the second liftable floor plate, wherein the second liftable floor plate is disposed below the first liftable floor plate.

* * * * *